US005136915A

United States Patent [19]

Shibukawa

[11] Patent Number: 5,136,915

[45] Date of Patent: Aug. 11, 1992

[54] TOUCH RESPONSE CONTROL FOR AN ELECTRONIC MUSICAL INSTRUMENT

[75] Inventor: Takeo Shibukawa, Hamamatsu, Japan

[73] Assignee: Yamaha Corporation, Hamamatsu, Japan

[21] Appl. No.: 502,036

[22] Filed: Mar. 29, 1990

[30] Foreign Application Priority Data

Mar. 31, 1989 [JP] Japan ..... 1-81040

[51] Int. Cl.[5] ..... G10H 1/02; G10H 1/46

[52] U.S. Cl. ..... 84/626; 84/DIG. 7; 84/658; 84/687; 84/701

[58] Field of Search ..... 84/DIG. 7, 616, 615, 84/626, 627, 644, 658, 663, 683, 687, 688, 689, 690, 236, 718, 719, 720, 743, 744, 745, 691, DIG. 8, 21, 462

[56] References Cited

U.S. PATENT DOCUMENTS

| | | | |
|---|---|---|---|
| 3,651,732 | 3/1972 | Erbert et al. | 84/236 |
| 4,299,153 | 11/1981 | Hoskinson et al. | 84/689 |
| 4,307,648 | 12/1981 | Stahnke | 84/462 |
| 4,469,000 | 9/1984 | Fujiwara | 84/658 |
| 4,593,592 | 6/1986 | Stahnke | 84/21 |
| 4,633,750 | 1/1987 | Sakai | 84/626 |
| 4,679,477 | 7/1987 | Monte | 84/DIG. 7 |
| 4,760,768 | 8/1988 | Yamamoto | 84/236 |
| 4,913,026 | 4/1990 | Kaneko et al. | 84/DIG. 7 |

FOREIGN PATENT DOCUMENTS 63-91694 4/1988 Japan .
1321488 12/1989 Japan .

*Primary Examiner*—William M. Shoop, Jr.
*Assistant Examiner*—Helen Kim
*Attorney, Agent, or Firm*—Graham & James

[57] ABSTRACT

In an electronic musical instrument capable of producing a key touch feeling resembling one in playing the piano by the provision of a hammer which is interlocked with a key, key-on data and touch data are generated in response to downward displacement of the key. In this type of electronic musical instrument, key-on data and touch data are also generated when the hammer is displaced upwardly and downwardly due to bounding of the hammer independently of the movement of the key. A touch control characteristic is established usually by using touch data generated in response to key-on data. When, however, second key-on data has been generated within a predetermined length of time after generation of preceding first key-on data, a touch control characteristic for the second on data is established by using first touch data generated in response to the first key-on data. By this arrangement, a touch response control of a tone signal corresponding to the second key-on data generated due to the hammer bound is made in accordance with the first touch data corresponding to real key touch during depression of the key.

12 Claims, 4 Drawing Sheets

TOUCH RESPONSE CONTROL FOR AN ELECTRONIC MUSICAL INSTRUMENT

BACKGROUND OF THE INVENTION

This invention relates to an electronic musical instrument of a type which controls tone characteristics such as tone volume by detecting touch data from a hammer interlocked with a key and, more particularly, to a technique for realizing optimum sounding of a tone which is generated based on bounding of the hammer.

Known is the art of an electronic musical instrument capable of producing a tone resembling a piano tone is the provision of a keyboard having hammers interlocked with keys for obtaining key touch feeling resembling one obtained in playing the piano (e.g., Japanese Patent Application Laid-open No. 91694-1988).

FIG. 5 shows an example of such prior art keyboard having hammers. In this figure, the structure of only one key, is shown in section. A column-shaped key support member KS is provided in a frame 10 and a key 12 is pivotably supported on this key support member KS. A column-shaped hammer support member HS is also provided in the frame 10 and a hammer 14 is pivotably supported on this hammer support member HS under the key 12.

The hammer 14 is provided with a projection EM which engages in an engaging recess ER formed in the side portion of the key 12. The hammer 14 is normally urged by a leaf spring 16 provided in the frame 10 to rotate upwardly about the hammer support member HS. The key 12 therefore is also urged to rotate upwardly through the projection EM of the hammer 14. The key 12 is provided in the end portion opposite to the portion supported by the key support member KS with engaging portions EPa and EPb. The engaging portion EPa can engage with a stop SP provided on the frame 10 from below and thereby determine the key releasing position by restricting the upward rotation of the key 12. The engaging portion EPb can engage the stop SP from above and thereby determine the deepest depressed position of the key 12 restricting the downward rotation of the key 12.

A plate PL is provided on the frame 10 at a position below the hammer 14. Switches MK1 and MK2 are provided in parallel to each other on the plate PL. The hammer 14 is provided at positions corresponding to the switches MK1 and MK2 with projections P1 and P2 for actuating the switches MK1 and MK2. The length of the downwardly projecting portion of the projection P1 is so set that it is longer than that of the projection P2. For this reason, when the hammer 14 has been moved downwardly in an interlocking motion with depression of the key 12, the switch MK1 is first turned on by the projection P1 and then the switch MK2 is turned on by the projection P2: In this case, time between start of turning on of the switch MK1 and start of turning on of the switch MK2 is shorter if the speed of depression of the key 12 is faster. Therefore, by controlling tone characteristics such as tone volume by detecting this time, a tone can be generated in accordance with the strength of key touch.

For restricting the downward rotation of the hammer 14, a damper DP is provided on the frame 10. The upward rotation of the hammer 14 is restricted by the key 12. When the key 12 is depressed slowly, bounding of the hammer 14 hardly occurs but when the key 12 is struck strongly, bounding of the hammer 14 often occurs. More specifically, the hammer 14 is depressed with depression of the key 12 and then displaced upwardly in reaction upon striking against the damper DP independently of the key 12 before the key 12 is released, and then displaced downwardly in reaction upon striking against the key 12. Such upward and downward bounds sometimes are repeated several times.

FIG. 6 is a graph showing an example of the conventional key-on touch detection and particularly such detection when the hammer bound has occurred.

When the key 12 is depressed to the deepest depression level L2 from level L1 in a key release state, the key 12 will follow the path as shown by curve A whereas the hammer 14 will follow the path as shown by curve B if the hammer bound occurs. The switch MK1 therefore is turned on at time t1 and turned off at time t4 and then is turned on again at time t5 so that an on-off signal C is obtained from the switch MK1. The switch MK2 is turned on at time t2 and turned off at time t3 and then is turned on again at time t6 so that an on-off signal D is obtained from the switch MK2.

In controlling tone generation in response to the signals C and D, first key-on data is generated at time t2 at which the switches MK1 and MK2 are both turned on, first key-off data is generated at time t4 at which the switches MK1 and MK2 are both turned off and second on data is generated at time t6 at which the switches MK1 and MK2 are both turned on again. Further, length of time between time t1 at which the on state of the switch MK1 is started and time t2 at which the on state of the switch MK2 is started is counted and first touch data TD1 corresponding to this time length is generated. Also, length of time between time t5 at which the on state of the switch MK1 is started again and time t6 at which the on state of the switch MK2 is started again is counted and second touch data TD2 corresponding to this time length is generated.

FIG. 7 shows a tone envelope shape produced on the basis of the above described key-on data, key-off data and touch data. The first tone is generated at time t2 in response to the first key-on data and starts to decay at time t4. The touch volume of the first tone is controlled in response to the first touch data TD1 but does not reach the peak level Lp corresponding to the touch data TD1 because the tone volume starts to decay at time t4 in response to the key-off data, so that the amplitude envelope assumes a shape as shown by curves A1 and A2.

Then, the second tone is generated at time t6 in response to the second key-on data. In response to generation of second key-off data at time tR upon release of the key 12, the second tone starts to decay. At this time, the tone volume of the second tone is controlled in response to the second touch data TD2 but, since the touch data TD2 corresponds to a tone volume level lower than the touch data TD1 (time length between time t5 and time t6 is longer than time length between time t1 and time t2), the amplitude envelope assumes a shape as shown by curves B1 and B2. The second tone normally predominates in the hearing sense so that it is difficult for a listener to discriminate the first tone from the second tone.

When a key has been struck strongly, it is desirable that an envelope amplitude as shown by the curves A1, A3 and A4 be obtained. In the prior art device, however, the tone volume of the second tone is controlled in response to the touch data based on a hammer bound and, accordingly, the amplitude envelope assumes a shape as shown by the curves B1 and B2. That is to say, such a tone is obtained is that could be obtained if the key was struck weakly in spite of the fact that the key has actually been struck strongly, with the result that discrepancy arises between the key touch feeling and the actually obtained tone.

For coping with this problem, it is conceivable to prohibit a tone control based on key-off data and key-on data within a predetermined length of time To starting from a time point immediately after time t2 and including times t4 to t6. According to this method, however, when a key is depressed weakly and released within the time To, decay of the tone is delayed from release of the key and starts from the end point of the time To, with the result that discrepancy arises between the feeling of the key release and the actually obtained tone.

SUMMARY OF THE INVENTON

It is, therefor, an object of the invention to eliminate the above described problem and provide an electronic musical instrument capable of producing a performance tone matching with actual performance feeling of the performer.

For achieving the above described object, the electronic musical instrument according to the invention comprises a key, a hammer provided for said key which is displaceable in a first direction in accordance with depression of said key and in a second direction opposite to the first direction in accordance with release of said key, and is also displaceable in the second direction and then in the first direction due to reaction independently of said key immediately after displacement in the first direction due to depression of said key, key-on data generation means for generating key-on data upon detecting displacement of said hammer in the first direction beyond a predetermined reference position, touch data generation means for generating touch data on the basis of speed or force of depression at the time when said hammer is displaced in the first direction, touch control establishing means for establishing a touch control characteristic for a tone corresponding to first key-on data usually by using first touch data generated by said touch data generation means in response to the first key-on data when the first key-on data has been generated by said key-on data generation means and establishing a touch control characteristic for a tone corresponding to second key-on data by using the first touch data generated by said touch data generation means in response to the first key-on data, when the second key-on data has been generated by said key-on data generation means within a predetermined length of time after a start of generation of the first key-on data, and tone generation means for generating a tone signal corresponding to said key each time said key-on data has been generated by said key-on data generation means and controlling the tone signal in accordance with the characteristics established by said touch control establishing means.

The key-on data generation means generates key-on data upon detecting displacement of the hammer in the first direction beyond the predetermined reference position and, accordingly, the key-on data is generated not only when the hammer is displaced in the first direction in accordance with actual depression of the key but also when the hammer is displaced in the first direction due to hammer bounding by reaction independently of the movement of the key.

The touch control establishing means establishes a touch control characteristic for the first key-on data usually by using the first touch data generated by the touch data generation means in response to the first key-on data when the first key-on data has been generated by the key-on data generation means. But, when the second key-on data has been generated by the key-on data generation means within a predetermined length of time after a start of generation of the first key-on data, this means establishes a touch control characteristic for the second key-on data by using the first touch data generated by the touch generation means in response to the first key-on data. This predetermined length of time is preferably shorter than the time interval from the start of a first depression of the key to the start of a succeeding second depression of the same key immediately after the first depression. Accordingly, when the first key-on data has been generated by the key-on data generation means by normal depression of the key, a touch control characteristic is established by using the first touch data corresponding to the first key-on data. When the second key-on data has been generated due to a hammer bound within the predetermined length of time after the start of generation of the first key-on data, a touch control characteristic for a tone corresponding to the second key-on data is established by using the first touch data corresponding to the first key-on data. Thus, the first touch data obtained when the key is actually depressed is utilized for establishing the touch control characteristic of a tone signal corresponding to the second key-on data responsive to the hammer bound. Accordingly, a touch control matching well with actual performance feeling of the performer can be realized.

If, for example, as shown in FIG. 8 in comparison with FIG. 7, first key-on data is generated at time t2 upon strong striking of a key,a first tone is generated responsive thereto in accordance with tone characteristics corresponding to first touch data and counting of the predetermined length of time T is started. When first key-off data has been generated at time t4 as a result of displacement of the hammer in the second direction die to reaction after displacement in the first direction, decay of the first tone is started. Therefore, as to the first tone, an amplitude envelope as shown by curves A1 and A2 is obtained in the same manner as in the case of FIG. 7.

When, thereafter, the second key-on data has been generated at time t6 due to displacement of the hammer from the first direction to the second direction due to reaction, a second tine is generated responsive thereto and counting of the remaining time of the predetermined length of time T is continued. At this time, tone characteristics of the second tone is established not in response to the second touch data due to the hammer bound but in response to the first touch data corresponding to the strong striking of the key so that, assuming that the tone characteristic is a tone volume characteristic, the second tone rises with a curve B1' resembling the curves A1 and A3.

When the second key-off data has been generated at time t time tR thereafter upon release of the key, decay of the second tone is started in response, thereto. A decay curve B2' at this time resembles a curve A4.

As will be apparent from comparison of FIGS. 7 and 8 with each other, according to the invention, an amplitude envelope as shown by the curves B1' and B2' resembling the desirable amplitude envelope shown by the curves A1, A3 and A4 is obtained whereby actual key touch feeling can be reflected in high fidelity on a tone produced.

Besides, according to the invention, decay of a tone may be started each time key-off data has been generated. Accordingly, in a case where key-off data has been generated in response to release of a key within the predetermined length of time T due to weak depression of the key, decay of the tone is started in response to this key-off data. An undesirable situation in which start of decay of a tone is delayed from release of the key therefore can be avoided.

Further, according to the invention, even when upward and downward bounds of a hammer have occurred twice consecutively upon depression of a key, a tone reflecting actual key touch feeling can be produced. More specifically, as shown in FIG. 8, after first and second tones have been generated one after another with envelopes shown as E1 and E2 in accordance with the first and second key-on data, a third tone with a tone volume characteristic shown by, for example, curves B1' and B2' corresponding to touch data of two times before (i.e., one at generation of the first on data) is generated in response to third key-on data based on the second upward and downward bounds. This third tone reflects key touch feeling at strong striking of the key.

An embodiment of the invention will now be described with reference to the accompanying drawings.

BRIEF DESCRIPTION OF THE DRAWINGS

In the accompanying drawings.

DESCRIPTION OF PREFERRED EMBODIMENTS

Figure 1:
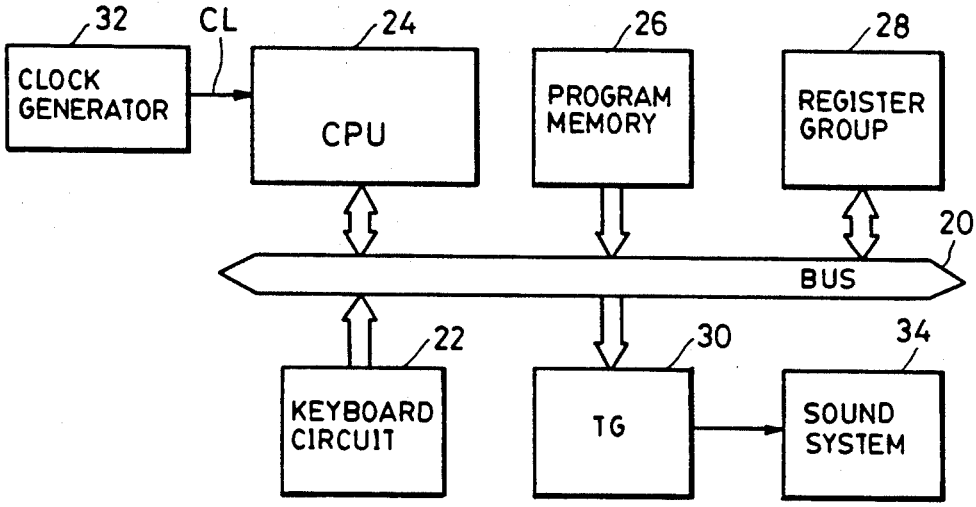
FIG. 1 is a block diagram showing an electronic musical instrument according to the invention.

Referring to FIG. 1, an embodiment of the electronic musical instrument according to the invention is controlled in its tone generation by a microcomputer.

STRUCTURE OF THE ELECTRONIC MUSICAL INSTRUMENT (FIG. 1)

To a bus 20 are connected circuits and elements including a keyboard circuit 22, a central processing unit (CPU) 24, a program memory 26, a register group 28 and a tone generator (TG) 30.

The keyboard circuit 22 includes a keyboard with hammers similar to those described with reference to FIG. 5, and key-on data, key-off data and touch data are detected from hammers interlocked with respective keys in a manner similar to the one described with reference to FIG. 6.

The CPU 24 executes various processings for generating a tone in accordance with a program stored in the program memory 26. These processings will be described later with reference to FIGS. 2 through 4. To the CPU 24 is supplied a clock signal CL from a clock generator 32 as an interruption command. The clock period of the signal CL is set at, for example, 1 ms.

The register group 28 includes registers for use in various processings by CPU 24, and those registers associated with carrying out the present invention will be described later.

The tone generator 30 has a suitable number of tone generation channels, for example, a total of 16 channels, from the zero-th to the fifteenth channels. Each of these tone generation channels can generate a tone signal of a tone pitch corresponding to a key code value with a tone volume corresponding to touch data. The key code value KCV is determined for each key in the following manner;

Key name—C2 . . . C3 . . . C4 . . . C5 . . . C6 . . . C7
KCV—36 . . . 48 . . . 60 . . .72 . . . 84 . . . 96

Tone signals from the tone generator 30 are supplied to a sound system 34 where they are converted to sound.

THE REGISTER GROUP 28

Among registers belonging to the register group 28, those relating to carrying out of this invention are as follows:

(1) ON-off flags KONBUF (0)-(15): These are 16 registers corresponding each to one of the zero-th to the fifteenth channels of the tone generator 30. Each register is a register of one bit in which 1 represents that a tone is being produced in the corresponding channel and 0 represents that a tone is decaying or no tone is being produced in the corresponding channel.

(2) Key-code buffer registers KCBUF (0)-(15): These are 16 registers each corresponding to one of the zero-th to the fifteenth channels. Each register can store a key code.

(3) Touch buffer registers TCHBUF (0)-(15): These are 16 registers each corresponding to one of the zero-th to the fifteenth channels. Each register can store touch data.

(4) Timer registers TMBUF (0)-(15): These are 16 registers each corresponding to one of the zero-th to the fifteenth channels. Each register is used for, for example, counting time of 36 ms.

(5) Key code register KC: In this register, when an on-event (key-on data) has been detected on any key, the key code for this is set.

(6) Touch data register TCH: In this register, when an on-event has been detected on any key, the touch data for this key is set.

(7) Channel-to-be-assigned register ASS: In this register, when an on-event has been detected on any key, the number of a channel to which the key should be assigned is set.

(8) Off channel register OFF: In this register, when an off-event (key-off data) has been detected on any key, the number of a channel in which decay of a tone should be started is set.

(9) Alreday-assigned-channel registers FND1, FND2: In these registers, when an on-event has been detected on any key, the number of a channel to which this key has already been assigned is set.

MAIN ROUTINE (FIG. 2)

Figure 2:
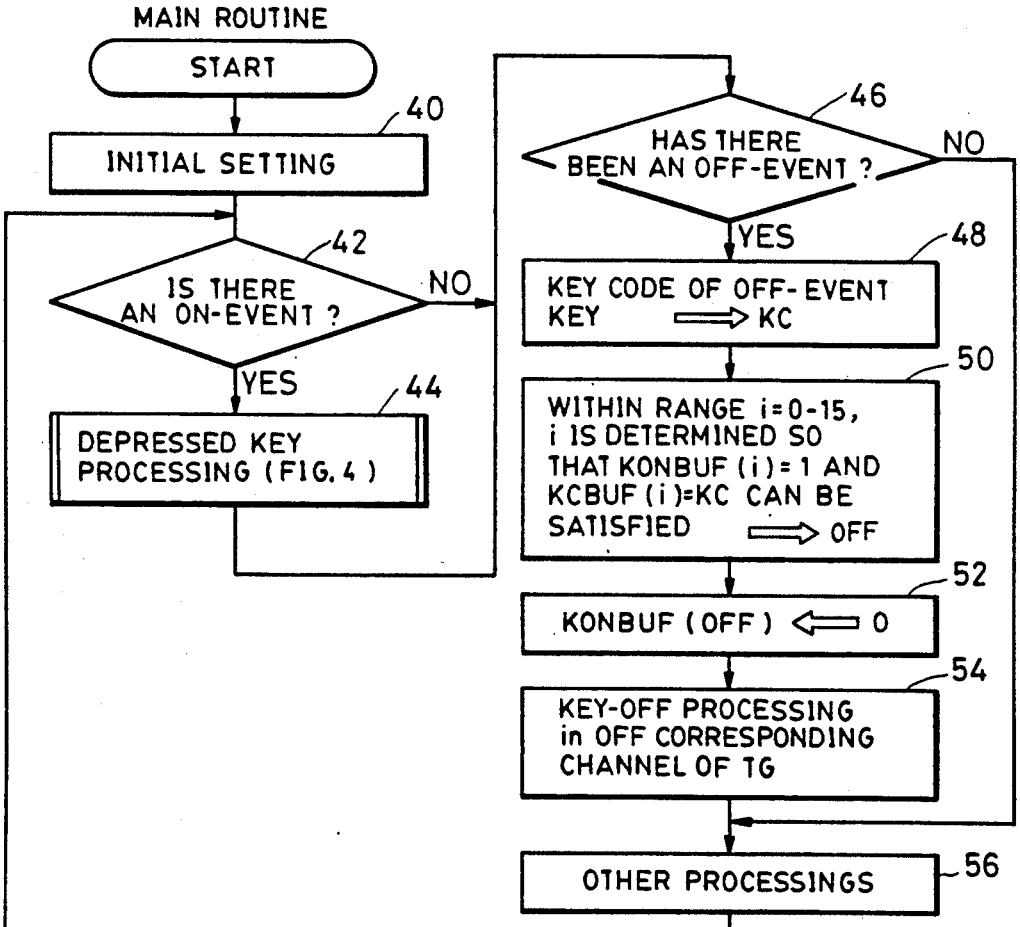
FIG. 2 is a flow chart showing an example of the main routine executed by a microcomputer employed in the embodiment.

FIG. 2 shows flow of the main routine which starts by a suitable means such as switching of a power source.

Initially in step 40, an initial setting processing is executed. For example, the registers KONBUF (0)-(15), KCBUF (0)-(15), TCHBUF (0)-(15) and TMBUF (0) -(15) are cleared. The routine then proceeds to step 42.

In step 42, the keyboard 22 is examined to judge whether or not there is an on-event on any key. If the result of judgement is YES, the routine proceeds to step 44 in which a sub-routine for depressed key processing is executed as will be described later with reference to FIG. 4.

Upon completion of step 44 or when the result of judgement of step 42 has been NO, the routine proceeds to step 46 in which the keyboard 22 is examined to judge whether or not there has been an off-event on any key. If the result of judgement is YES, the routine proceeds to step 48 in which the key code of the key on which the off-event has occurred is set in the key code register KC. The routine then proceeds to step 50.

In step 50, a control variable i is determined from within a range of i=0 to 15 so that i will satisfy both KONBUF (i)=1 and KCBUF (i)=KC, and thus the obtained control variable i is set in the off channel register OFF. In other words, a channel generating a tone to which the key code for the key on which the off-event has occurred has already been assigned is searched for and the number i of this channel is set in the off channel register OFF. Then, the routine proceeds to step 52.

In step 52, the on-off flag KONBUF (OFF) corresponding to the channel number stored in the register OFF is set to 0. The routine then proceeds to step 54 in which key-off processing is executed, i.e., decay of a tone signal of the channel corresponding to the channel number of the off channel register OFF is started in the tone generator 30.

Upon completion of the processing in step 54 or when the result of judgment in step 46 has bee NO, the routine proceeds to step 56 in which other processings are executed. These other processings include various known setting operations by manipulation of unillustrated tone color setting operators, tone volume setting operators and effect settting operators, and detailed description of such processings will be omitted.

After step 56, the routine returns to step 42 and the above described processings are repeated.

CLOCK INTERRUPTION ROUTINE (FIG. 3)

Figures 3, 4A:
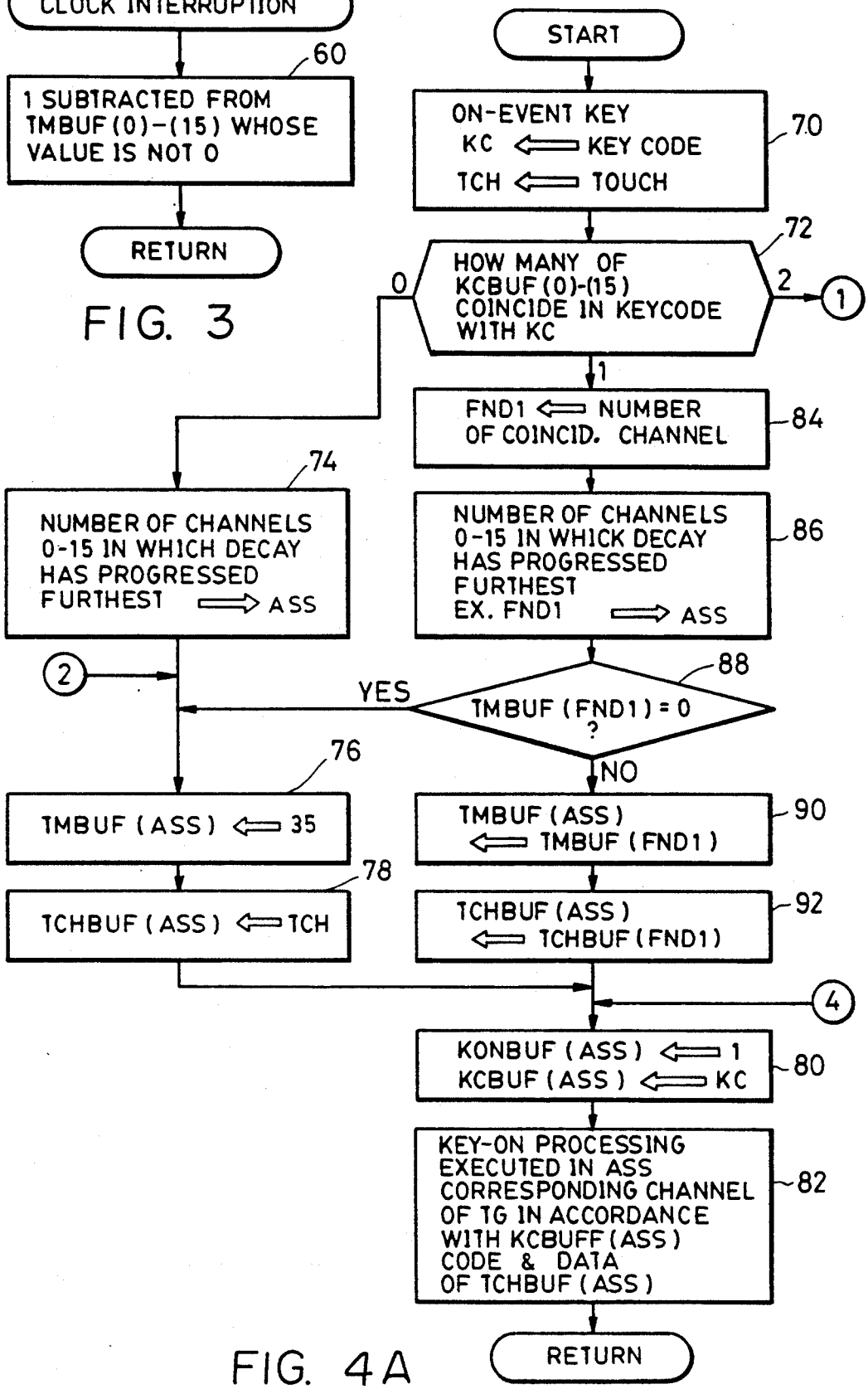
FIG. 3 is a flow chart showing an example of a clock interruption routine.
FIGS. 4A and 4B are flow charts showing an example of a depressed key processing subroutine.

FIG. 3 shows the clock interruption routine. This routine starts in response to each clock pulse of the clock signal CL and is repeated with a period of 1 ms.

In step 60, 1 is substracted from contents of the timer register TMBUF (0)-(15) whose value is not 0. The routine then returns to the main routine of FIG. 2 Setting of numerical values to the registers TMBUF is made by the routine of FIG. 4A.

SUBROUTINE OF DEPRESSED KEY PROCESSING (FIGS. 4A AND 4B)

Figure 4B:
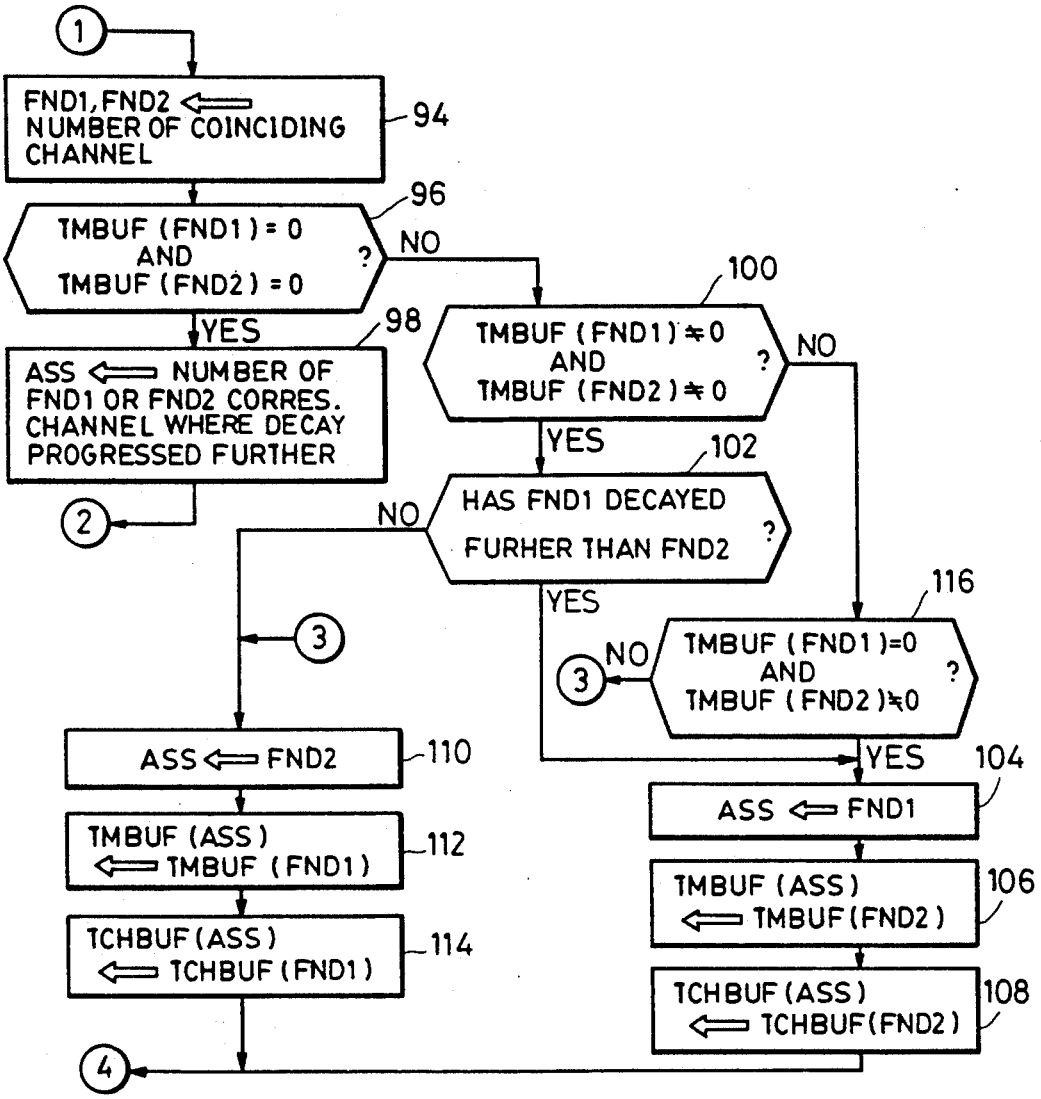

FIGS. 4A and 4B show the subroutine of depressed key processing. In step 70, the key code of the key on which the on-event has occurred is set in the register KC, and the touch data is set in the register TCH.

In step 72, how many registers of the key code buffer registers KCBUF (0)-(15) store key codes which coincide with key codes of the key code register KC is judged. If the result of judgment in this step is 0, it indicates that the key on which the on event has been detected has not been assigned to any channel yet, and the routine proceeds to step 74.

In step 74, search is made for a channel in which decay of a tone has progressed to the furthest degree among the zero-th to the fifteenth channels and the number of the detected channel is set at the channel-to-be-assigned register ASS. The routine then proceeds to step 76.

In step 76, numerical value 35 is set at the timer register TMBUF (ASS) corresponding to the channel number of the register ASS. Thereafter, counting of 35 ms by the routine of FIG. 3 is started.

Then, in step 78, touch data of the touch data register TCH is set at the touch buffer register TCHBUF (ASS) corresponding to the channel number of the channel-to-be-assigned register ASS. The routine then proceeds to step 80.

In step 80, the on-off flag KONBUF (ASS) corresponding to the channel number of the channel-to-be-assigned register ASS is set to 1 and the key code of the key code register KC is set at the key code buffer register KCBUF (ASS) corresponding to the channel number of the register ASS. The routine then proceeds to step 82.

In step 82, the key-on processing is executed. More specifically, in the channel corresponding to the channel number of the register ASS (channel to be assigned) in the tone generator 30, generation of a tone signal having a tone pitch corresponding to the key code of the register KCBUF (ASS) is started in accordance with a tone volume characteristic corresponding to the touch data of the register TCHBUF. Thereafter the routine returns to the main routine of FIG. 2.

If the result of judgement in step 72 has been 1, there is one channel to which the key on which the current on-event has occurred has already been assigned and the number of the coinciding channel (the channel to which the key has already been assigned) is set at the already-assigned channel register FND1 in step 84. Then the routine proceeds to step 86.

In step 86, search is made for a channel in which decay of a tone has progressed to the furthest degree among the zero-th to the fifteenth channels excluding one corresponding to the register END1 and the number of the detected channel is set at the register ASS. In this case, therefore, a channel other than the channel to which the key has already been assigned constitutes the channel to which the key should be assigned. Thereafter, the routine proceeds to step 88.

In step 88, whether or not the value of the timer register TMBUF (FND1) corresponding to the channel number of the register FND1 is 0 is judged. Since numerical value 35 was set at the register TMBUF (FND1) by step 76 when the preceding on-event was detected on the same key that the current on-event has occured, TMBUF (FND1)=0 corresponds to the finish of counting of 35 ms. The counting time of 35 ms is set by way of example as time length within a range shorter than the shortest period of time during which the same key can be manually struck repeatedly. Accordingly, the fact that the result of judgement of step 88 is YES means that the current on-event is based on a manual repeated striking of the same key whereas the fact that the result of judgement of step 88 is NO means that the current on-event is based on a hammer bound as in the case of time t6 in FIG. 6.

When the result of judgement in step 88 has been YES, the routine proceeds to step 76 and the subsequent processings are executed in the manner described above. In other words, processings are made on the assumption that a new key has been depressed. That is to say, in the register TMBUF (ASS), counting of 35 ms is started by the routine of FIG. 3 after the processing of step 76. In the channel of the tone generator 30 corresponding to the register ASS, generation of a tone signal corresponding to the key on which the current on-event has occurred is started in accordance with a tone volume characteristic corresponding to the current touch data of the key (i.e., touch data set at the register TCHBUF (ASS) in step 78).

If the result of judgement in step 88 has been NO, the routine proceeds to step 90 in which the value of the timer register TMBUF (FND1) corresponding to the channel of FND1 is set at the timer counter register TMBUF (ASS) corresponding to the channel of the register ASS. Since "35" has been at the register TMBUF (FND1) by the processing of step 76 during detection of the preceding on-event on the same key that the current on-event has occurred, counting of the remaining time in 35 ms is continued in the register TMBUF (ASS) by the routine of FIG. 3 after the processing of step 90.

Then, in step 92, touch data of the touch buffer register TCHBUF (FND1) corresponding to the channel of FND1 is set at the touch buffer register TCHBUF (ASS). Since preceding touch data (the first touch data during depression of the key and corresponding to TD1 in FIG. 6) on the same key that the current on-event has occurred has been set at the register TCHBUF (FND1) during detection of the preceding on-event on this key, touch data set this time at the register TCHBUF (ASS) is this preceding touch data.

After step 92, the routine proceeds to step 80 and the subsequent processings are executed in the same manner as described above. In the channel corresponding to the register ASS in the tone generator 30, therefore, generation of a tone signal corresponding to the key on which the current on-event has occurred is started in accordance with a tone volume characteristic corresponding to the preceding touch data.

If the result of judgement in step 72 has been 2, it means that there are two channels to which keys on which the current on-event has occurred have already been assigned. The routine proceeds to step 94 (FIG. 4B) in which the numbers of the two already-assigned channels are set at the registers FND1 and FND2. In this case, the number of one of the two channels in which decay of a tone has progressed further than the other is not necessarily set at the first register FND1 but may be set at the second register FND2. After step 94, the routine proceeds to step 96.

In setep 96, whether or not values of the timer registers TMBUF (FND1) and TMBUF (FND2) corresponding to the channel numbers of the registers FND1 and FND2 are both 0 (i.e., whether or not counting of 35 ms has finished) is judged. It is when, for example, the same key has been struck manually three times in sequence that this result of judgment becomes YES.

If the result of judgement in step 96 has been YES, the routine proceeds to step 98 in which the number of one of the two already-assigned channels corresponding to the registers FND1 and FND2 in which decay of a tone has progressed further than the other is set at the register ASS. The routine then proceeds to step 76 (FIG. 4A) and the subsequent processings are executed in the same manner as described above. In this case, therefore, generation of a tone is started in the same manner as described before with respect to a case where the result of judgement in step 88 has been YES.

If the result of judgement in step 96 has been NO, the routine proceeds to step 100 in which whether values of the timer registers TMBUF (FND1) and TMBUF (FND2) are both not 0 (i.e., whether counting of 35 ms is still going on) or not is judged. It is when, for example, the hammer has bounded up and down and then bounded up and down again in FIG. 6 that this result of judgement becomes YES.

If the result of judgement in step 100 is YES, the routine proceeds to step 102 in which whether or not decay of a tone in the channel corresponding to FND1 has progressed further than in the channel corresponding to FND2 is judged. If the result of judgement is YES, it means that decay of a tone signal corresponding to an on-event such as at time t2 in FIG. 6 has been started in the channel corresponding to FND1 and then decay of a tone signal corresponding to an on-event such as at time t6 in FIG. 6 has been started in the channel corresponding to FND2. If the result of judgement in step 102 is NO, it means that decay of a tone signal corresponding to an on-event as time t2 in FIG. 6 is started in the channel corresponding to FND2 and then decay of a tone signal corresponding to an on-event such as at time t6 in FIG. 6 has been started in the channel corresponding to FND1.

If the result of judgement in step 102 is YES, the routine proceeds to step 104 in which the channel number in FND1 is set at the register ASS so as to turn the channel corresponding to FND1 to a channel to which the key should be assigned. The routine then proceeds to step 106.

In step 106, the value of the register TMBUF (FND2) is set at the register TMBUF (ASS). Since the value corresponding to the remaining time in 35 ms has been set at the register TMBUF (FND2) in step 90 during detection of the preceding on-event on the same key that the current on-event has occurred, the register TMBUF (ASS) continues counting of the remaining time by the routine of FIG. 3.

Then, in step 108, touch data of the register TCHBUF (FND2) is set at the register TCHBUF (ASS). Since touch data of two times before on the same key that the current on-event has occurred (i.e., the first touch data during depression of the key and corresponding to TD1 in FIG. 6) has been set at the register TCHBUF (FND2) by step 92 during detection of the preceding on-event on this key, the touch data which has currently been set at the register TCHBUF (ASS) is the touch data of two times before on the same key.

After step 108, the routine proceeds to step 80 (FIG. 4A) and the subsequent processings are executed in the same manner as described before. In the channel corresponding to ASS in the tone generator 30, therefore, generation of a tone signal corresponding to the key on which the current on-event has occurred is started in accordance with a tone volume characteristic corresponding to the touch data two times before on the same key.

If the result of judgement in step 102 has been NO, the routine proceeds to step 110 in which the channel number of FND2 is set at the register ASS so as to turn the channel corresponding to FND2 to a channel to which the key should be assigned. The routine then proceeds to step 12.

In step 112, the value of the register TMBUF (FND1) is set at the register TMBUF (ASS). In step 114, touch data of the register TCHBUF (FND1) is set at the register TCHBUF (ASS). Thereafter, the routine proceeds to step 80 and the subsequent processings are executed in the same manner as described before.

In processings of steps 110–114 are equivalent to the processings of steps 104–108 except that FND1 is changed to FND2 and FND2 is changed to FND1 so that they are the same in respects that the rest of the remaining time is continously counted in the register TMBUF (ASS) and that touch data of two times before is set at the register TCHBUF (ASS). In the steps 110–114, therefore, a tone signal is generated in the tone generator 30 in the same manner as the processings are executed in steps 104–108 except that the channel to which the key should be assigned is changed from the channel corresponding to FND1 to that corresponding to FND2.

Figure 5:
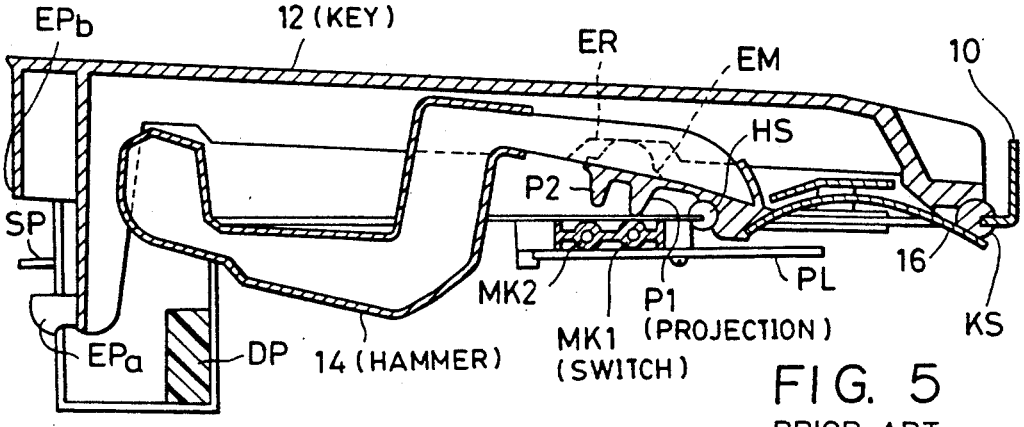
FIG. 5 PRIOR ART
FIG. 5 is a sectional view of a known keyboard and its interlocked hammer.
Figure 6:
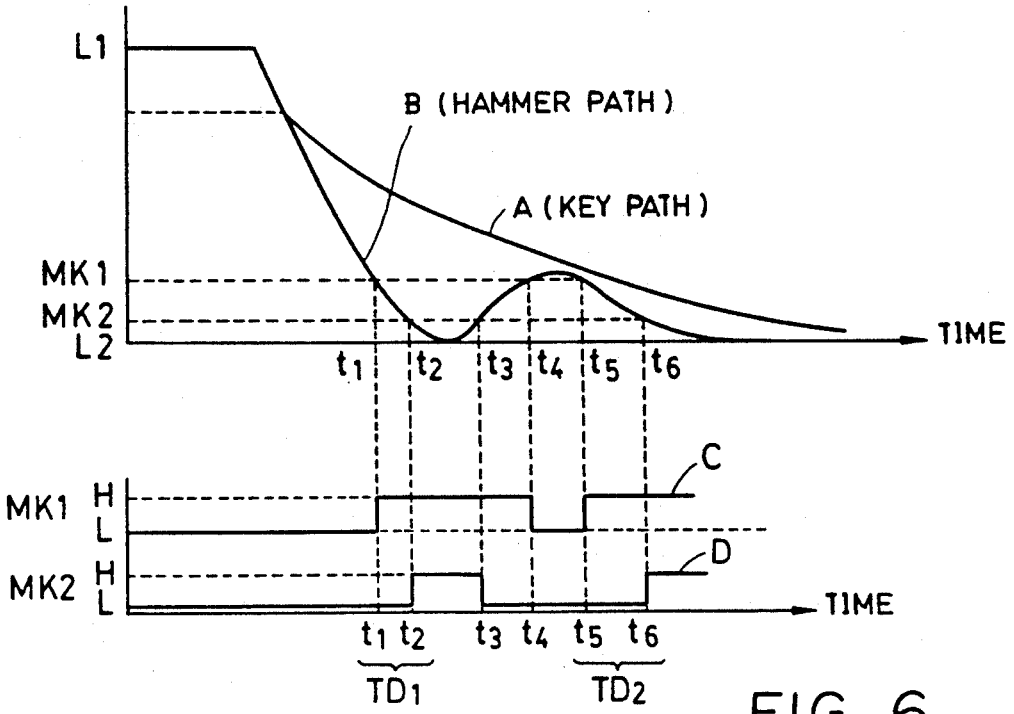
FIG. 6 PRIOR ART
FIG. 6 is s time chart showing a prior art example of key-on and touch detection.
Figure 7:
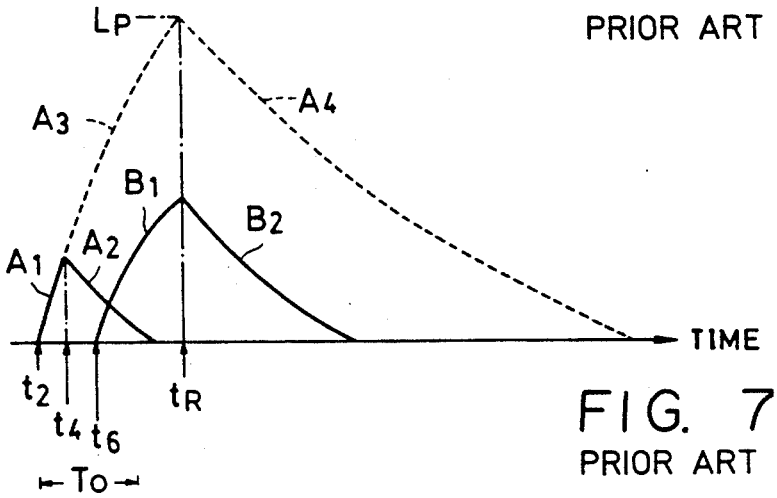
FIG. 7 PRIOR ART
FIG. 7 is a waveform diagram showing an example of tone envelope shape which is touch controlled by the prior art control method.

It is when value of one of the registers TMBUF (FND1) and TMBUF (FND2) is 0 and value of the other is not 0 that the result of judgement in step 100 becomes NO, for example, when, after lapse of 35 ms after detection of an on-event upon depression of a key 12 in FIG. 5, the same key has been depressed again whereby an on-event has been detected at time t2 as shown in FIG. 6 and an on-event based on a hammer bound has been detected at time t6.

If the result of judgement in step 100 is NO, the routine proceeds to step 116 in which whether or not value of the register TMBUF (FND1) is 0 and value of the register TMBUF (FND2) is not 0 is judged. If the result of judgement is YES, it means that detection of the on-event is earlier in the channel corresponding to the channel FND1 and the routine proceeds to step 104 and the subsequent processings are executed in the same manner as described before. As a result, the channel to which the key should be assigned becomes the channel corresponding to FND1 and the timer register TMBUF (ASS) corresponding to the channel to which the key should be assigned continues counting of the remaining time corresponding to the value of the register TMBUF (FND2) by the routine of FIG. 3 after step 106. In the channel to be assigned in the tone generator 30, generation of a tone signal corresponding to the key on which the current on-event has occurred is started in accordance with a tone volume characteristic corresponding to the preceding touch data (touch data set at the register TCHBUF (ASS) in step 108 and corresponding to TD1 in FIG. 6) on the same key.

If the result of judgement in step 116 is NO, it means that TMBUF (FND1) $\neq 0$ and TMBUF (FND2) $= 0$ so that detection of an on-event is earlier in the channel corresponding to FND2. The routine then proceeds to step 110 and the subsequent processings are executed in the same manner as described before. As a result, the channel to which the key should be assigned becomes the channel corresponding to FND2 and the timer register TMBUF (ASS) corresponding to the channel to which the key should be assigned continues counting of the remaining time corresponding to the value of the register TMBUF (FND1) by the routine of FIG. 3 after step 112. In the tone generator 30, a tone signal is generated in the same manner as the processings are executed by steps 104–108 except that the channel to which the key should be assigned is changed from the channel corresponding to FND1 to that corresponding to FND2.

TONE GENERATION OPERATION (FIG. 8)

Figure 8:
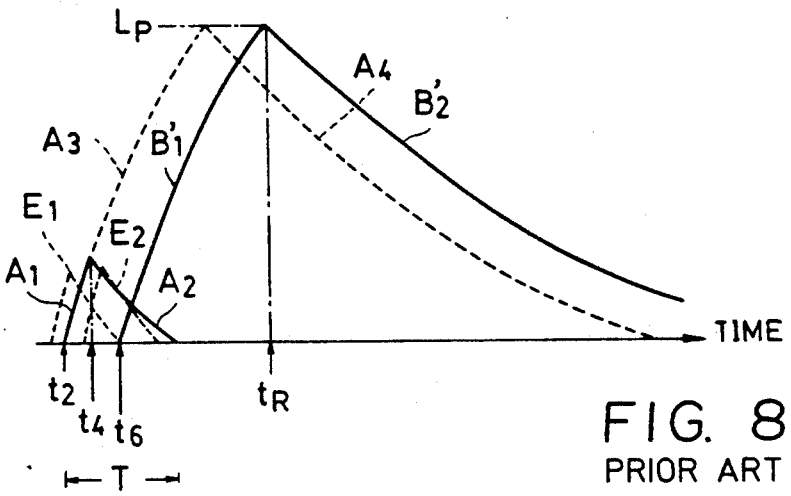
FIG. 8 PRIOR ART
FIG. 8 is a waveform diagram showing an example of tone envelope shape which is touch controlled by the embodiment of the invention.

The tone generation operation in FIG. 8 will now be described in connection with the above described processings.

If there is no coincidence of the key code in the key code buffer registers KCBUF(0)–(15) when the on-event at time t2 of FIG. 6 has been detected, the first tone is generated by steps 74–80. The tone volume characteristic at this time is controlled in accordance with the current touch data TD1 set at the touch buffer register TCHBUF (ASS) in step 78 and the first tone rises as shown by curve A1.

Thereafter, when the off-event of time t4 has been detected on the basis of a hammer bound, decay of the first tone is started by steps 48–54 of FIG. 2 and the first tone is decayed as shown by curve A2.

Thereafter, when the on-event of time t6 has been detected on the basis of a hammer bound, the result of judgement of step 72 becomes "1". When the routine has proceeded to step 88 through steps 84 and 86, the result of judgement becomes NO and the second tone is generated by steps 90, 92, 80 and 82. The tone volume characteristic at this time is controlled in accordance with the preceding touch data TD1 set at the touch buffer register TCHBUF (ASS) in step 92 and the second tone rises as shown by curve B1'.

Thereafter, when the off-event of time tR has been detected in response to release of the key, decay of the second tone is started by steps 48–54 of FIG. 2 and the second tone decays as shown by curve B2'.

If, in the above described operation, there is one or two coinciding key codes in the key code buffer registers KCBUF (0)–(15) when the on-event of time t2 has been detected and the result of judgement in step 88 or 96 has been YES, the first tone is generated by steps 76, 78, 88 and 82. Thereafter, if the on-event of time t6 has been detected after the tone decay processing corresponding to time t4, the result of judgement in step 72 becomes "2". The results of judgement in steps 96 and 199 become both "NO" and the second tone is generated by processings of step 116 and subsequent steps. In this case also, therefore, a tone envelope shown by curves A1, A2, B1' and B2' is obtained in the same manner as described before.

In the case where there have been two consecutive upward and downward bounds of the hammer accompanying depression of the key, the first tone is generated by steps 76–82 in response to the first on-event accompanying depression of the key. Then, the first tone starts to decay in response to the first off-event based on the first upward bound of the hammer. The envelope of the first tone, therefore, becomes as shown by dotted line E1 in FIG. 8.

Thereafter, responsive to the second on-event based on the first downward bound of the hammer, the second tone is generated by steps 84–88, 90, 92, 80 and 82. Then the second tone starts to decay in response to the second off-event based on the second upward bound of the hammer. The envelope of the second tone, therefore, becomes as shown by dotted line E2 in FIG. 8.

Thereafter, resonsive to the third on-event based on the second downward bound of the hammer, the result of judgement in step 72 becomes "2". The result of judgement in step 96 becomes NO and the result of judgement in step 100 becomes YES. Therefore, the third tone is generated by processings of step 102 and subsequent steps. The tone volume characteristic at this time is controlled in accordance with the touch data two times before (one detected at the first on-event) so that the third tone rises as shown by curve B1'. Thereafter, upon detection of the third off-event in response to release of the key, the third tone decays as shown, for example, by curve B2' in FIG. 8.

MODIFIED EXAMPLES

The invention is not limited to the above described embodiment but can be realized in various modifications. For example, the following modifications can be made:

Timer means may be a hardware structure such as a timer.

The predetermined time counted by the timer means is not limited to 35 ms but may be determined at a suitable length of time within a range which is shorter than the shortest time within which the same key can be struck manually repeatedly.

For generating key-on data, key-off data and touch data upon detecting displacement of the hammer, not only a switch but also a pressure sensor may be utilized.

For setting a tone characteristic at the time of detection of bound, a value obtained by modifying the first touch data, e.g., a value obtained by averaging the first touch data and the current touch data, may be employed in place of the first touch data which is directly used.

As described in the foregoing, according to the invention, a tone characteristic is determined by employing the first touch data accompanying depression of the key and, accordingly, a tone reflecting key touch feeling can be produced despite occurrence of a hammer bound due to strong striking of the key. Besides, since the tone decay processing is made during counting of a predetermined period of time, decay of the tone responding accurately to release of the key can be made even when the key has been released within a certain period of time due to weak striking of the key.

Consequently, a performance tone matching well with actual performance feeling of the performer can be obtained whereby an effect of enabling the performer to enjoy a pleasant performance can be produced.

What is claimed is:

1. An electronic musical instrument comprising:

a key;

a hammer provided for said key which is displaceable in a first direction in accordance with depression of said key and in a second direction opposite to the first direction in accordance with release of said key, and is displaceable in the second direction and then in the first direction due to reaction independently of said key immediately after displacement in the first direction due to depression of said key;

key-on data generation means for generating key-on data upon detecting displacement of said hammer in the first direction beyond a predetermined reference position;

touch data generation means for generating touch data representing intensity of depression at the time when said hammer is displaced in the first direction;

touch control establishing means for establishing a touch control characteristic for a tone corresponding to first key-on data usually by using first touch data generated by said touch data generation means in response to the first key-on data when the first key-on data has been generated by said key-on data generation means, and establishing a touch control characteristic for a tone corresponding to second key-on data by using the first touch data generated by said touch data generation means in response to the first key-on data when the second key-on data has been generated by said key-on data generation means within a predetermined length of time after a start of generation of the first key-on data; and tone generation means for generating a tone signal corresponding to said key each time said key-on data has been generated by said key-on data generation means and controlling the tone signal in accordance with the characteristics established by said touch control establishing means.

2. An electronic musical instrument as defined in claim 1 wherein said touch control establishing means establishes, when third key-on data has further been generated within a predetermined length of time after generation of the first key-on data by said key-on data generation means, a touch control characteristic for the third key-on data by using the first touch data generated by said touch data generation means in response to the first key-on data.

3. An electronic musical instrument as defined in claim 1 wherein said touch control establishing means establishes, when the second key-on data has been generated within a predetermined length of time after generation of the first key-on data by said key-on data generation means, a touch control characteristic for the second key-on data by combining the first touch data generated by said touch data generation means in response to the first key-on data with the second touch data generated by said touch generation means in response to the second key-on data.

4. An electronic musical instrument as defined in claim 1 wherein said touch control establishing means comprises:

timer means capable of counting said predetermined length of time, said predetermined length of time being determined taking account of the motion of said hammer due to reaction independent of said key;

judgement means for judging whether or not said timer means is counting said predetermined length of time each time the key-on data is generated by said key-on data generation means;

timer control means for causing said timer means to start counting of said predetermined length of time if result of judgement by said judgement means is NO and causing said timer means to continue counting of remaining time of said predetemined length of time; and means for establishing a touch control characteristic for current key-on data by using touch data generated by said touch data generation means in response to the current key-on data if result of judgement by said judgement means is NO and, if result of judgement by said judgement means is YES, establishing a touch control characteristic for second key-on data which has currently been generated by using first touch data generated by said touch data generation means in response to first key-on data preceding the second key-on data.

5. An electronic musical instrument as defined in claim 1 wherein said key-on data generation means comprises first and second switch means that is actuated sequentially when said hammer is displaced in the first direction, and means for generating key-on data when said first switch means is actuated first and said second switch means is actuated next.

6. An electronic musical instrument as defined in claim 1 wherein there are a plurality of said keys and said hammer is provided for each of said keys.

7. An electronic musical instrument as defined in claim 1 further comprising key-off data generation means for generating key-off data upon detection of displacement of said hammer in the second direction and means for controlling said tone generation means to decay the tone signal each time the key-off data is generated.

8. An electronic musical instrument as in claim 1, wherein the touch data generation means includes means for determining speed of hammer depression to generate said touch data.

9. An electronic musical instrument comprising:

a key;

means for generating a key-on signal and touch data in response to depression of said key, said touch data representing intensity of the depression of said key;

timer means for counting a predetermined time length from a time at which a key-on signal is first generated upon the depression of the key;

storage means for storing touch data corresponding only to said key-on signal first generated upon the depression of the key; and tone generation means for generating a musical tone by using said touch data stored in said storage means instead of using touch data that corresponds to any other key-on signal generated during said predetermined time length.

10. An electronic musical instrument as defined in claim 9 wherein a hammer is provided for cooperating action with said key, said hammer being displaceable in a first direction in accordance with depression of said key and in a second direction in accordance with release of said key, and being also displaceable in the second direction and then in the first direction due to reaction independently of said key immediately after displacement in the first direction due to depression of said key.

11. An electronic musical instrument as defined in claim 10 wherein said means for generating a key-on signal and touch data comprises key-on data generation means for generating key-on data upon detecting displacement of said hammer in the first direction beyond a predetermined reference position, and touch data generation means for generating touch data on the basis of intensity of depression at the time when said hammer is displaced in the first direction.

12. An electronic musical instrument as in claim 8, wherein said touch data represents speed of key depression.

* * * * *